US009557147B1

(12) United States Patent
Hahn

(10) Patent No.: US 9,557,147 B1
(45) Date of Patent: Jan. 31, 2017

(54) CENTERPIN ARROWHEAD ADAPTER

(71) Applicant: Brent Hahn, Salem, OR (US)

(72) Inventor: Brent Hahn, Salem, OR (US)

( * ) Notice: Subject to any disclaimer, the term of this patent is extended or adjusted under 35 U.S.C. 154(b) by 0 days.

(21) Appl. No.: 14/952,215

(22) Filed: Nov. 25, 2015

(51) Int. Cl.
*F42B 6/08* (2006.01)
*F42B 6/04* (2006.01)

(52) U.S. Cl.
CPC .. *F42B 6/08* (2013.01); *F42B 6/04* (2013.01)

(58) Field of Classification Search
CPC ..... F42B 6/08
See application file for complete search history.

(56) References Cited

U.S. PATENT DOCUMENTS 7,115,055 B2 * 10/2006 Palomaki ..... F42B 6/08 473/578
7,651,421 B2 * 1/2010 Smith ..... F42B 6/04 473/582
8,784,243 B2 * 7/2014 James ..... F42B 6/04 473/578
9,410,773 B2 * 8/2016 Greenwood ..... F42B 6/08
2009/0163308 A1 * 6/2009 Odabachian ..... F42B 6/08 473/582
2016/0054106 A1 * 2/2016 Perry ..... F42B 6/08 473/583

* cited by examiner

*Primary Examiner* — John Ricci
(74) *Attorney, Agent, or Firm* — Crowell Law

(57) ABSTRACT

An adaptor for mounting arrowheads to arrow shafts is disclosed. Example embodiments include a collar assembly portion that engages the outer surface of a hollow arrow shaft, and an adaptor with an inner centerpin attachment portion that engages the inner surface of the hollow arrow shaft. Other embodiments may include single-piece adaptors configured to receive the end of a hollow arrow shaft, and adaptors with arrowhead receiving portions.

10 Claims, 2 Drawing Sheets

CENTERPIN ARROWHEAD ADAPTER

FIELD OF INVENTION

The present invention relates generally to archery and more particularly pertains to an adaptor used to mount arrowheads to arrow shafts.

SUMMARY OF THE INVENTION

It is an object of the present invention to provide an improved adaptor for mounting arrowheads to arrow shafts. In accordance with a first aspect of one of the embodiments of the invention, an adaptor is provided with a forward end for receiving an arrowhead and a centerpin on the rearward end for insertion into an arrow shaft. Disposed along the centerpin are a plurality of recesses, and at the conjunction of the centerpin and the forward end is a threaded neck and a face plate. When the centerpin is inserted into conventional arrow shaft the centerpin diameter approximates the inner diameter of the arrow shaft.

The invention further comprises a collar unit which is preferably tapered with a collar shaft for receiving a conventional arrow shaft on one end and a threaded receiver for receiving the threaded neck of the adaptor and a collar face for engaging and being displaced flush against the face plate of the adaptor.

In use, an arrow shaft is place in the collar shaft of the collar and then the centerpin of the adaptor is inserted into the arrow shaft and secured by means such as glue. The collar shaft threaded receiver is then engaged with the threaded neck to secure the adaptor and collar together. Thus in operation the centerpin extends into the arrow shaft and the collar is then displaced around a portion of the arrow shaft to reinforce the forward portion of the completed arrow.

The forward end may then be mounted with a broadhead, field tip, or any of a number of standard arrowheads.

In accordance with another aspect of the embodiments of the present invention, the adaptor portion has an integral broadhead arrowhead forming a singular adaptor-arrowhead unit that is then secured to the arrow shaft with the collar.

In accordance with another aspect of embodiments of the present invention, the adaptor portion has an integral field tip arrowhead forming a singular adaptor-arrowhead unit that is then secured to the arrow shaft with the collar.

This summary is provided to introduce a selection of the concepts that are described in further detail in the detailed description and drawings contained herein. This summary is not intended to identify any primary or essential features of the claimed subject matter, nor is it intended to be used as an aid in determining the scope of the appended claims. Each embodiment described herein is not intended to address every object described herein, and each embodiment does not include each feature described. Other forms, embodiments, objects, advantages, benefits, features, and aspects of the present invention will become apparent to one of skill in the art from the detailed description and drawings contained herein.

BRIEF DESCRIPTION OF THE DRAWINGS

The above description and other objects, advantages, and features of the present embodiment will be more fully understood and appreciated by reference to the specification and accompanying drawings, wherein.

DETAILED DISCUSSION OF THE PREFERRED EMBODIMENT

Figure 1:
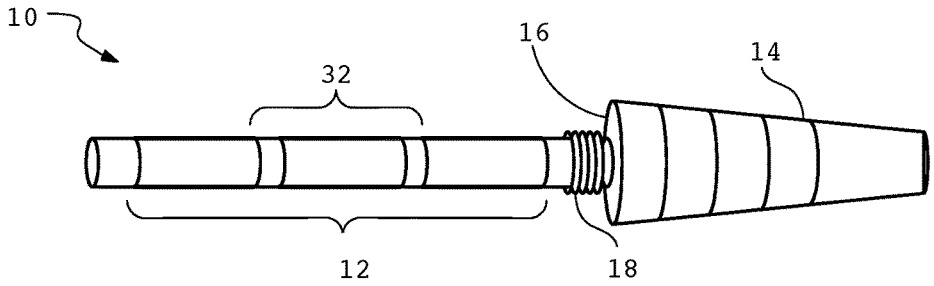
FIG. 1 is a detailed view of the adaptor

For the purposes of promoting an understanding of the principles of the invention, reference will now be made to the selected embodiments illustrated in the drawings and specific language will be used to describe the same. It will nevertheless be understood that no limitation of the scope of the invention is hereby intended. Alterations, modifications, and further applications of the principles of the invention are contemplated as would normally occur to one skilled in the art to which the invention relates. At least one embodiment of the invention is shown in great detail, although it will be apparent to those skilled in the relevant art that some features that are not relevant to the present invention may not be shown for the sake of clarity.

Embodiments of the present invention generally assist in mounting an arrowhead to an arrow shaft and reinforcing the forward portion of an arrow shaft. Preferably, the adaptor enhances the strength of the junction between the arrowhead and the arrow shaft as well as maintaining alignment of the arrowhead with the central axis of the shaft. The forward end of the adaptor is configured to receive an arrowhead such as a field tip or a broadhead style arrowhead.

Illustrations of an adaptor 10 according to a preferred embodiment of the present invention are shown in FIGS. 1-5. The adaptor 10 includes a forward end 14 and a rearward centerpin 12. The forward end 14 has an arrowhead attachment portion, for receiving an arrowhead such as a broadhead or field tip type arrowhead. The centerpin 12 is a reduced diameter insert for insertion into the body of an arrow shaft 100.

FIG. 1 depicts the preferred form of the adapter with centerpin 12 and a series of recesses 32 displaced along the length of the centerpin 12. In the preferred embodiment the body of the centerpin 12 approximates the inner diameter of the arrow shaft 100 to be used with the recesses 32 providing a reduced diameter.

The forward end 14 of the adaptor 10 provides for standard mounting of an arrowhead, and at the conjunction of the centerpin 12 and the forward end 14 is a threaded neck 18 for engaging the threaded receiver 28 of the collar 20. At the base of the forward end 14 is a face plate 16 which when in use is engaged flush with the collar face 26 of the collar 20.

Figure 2:
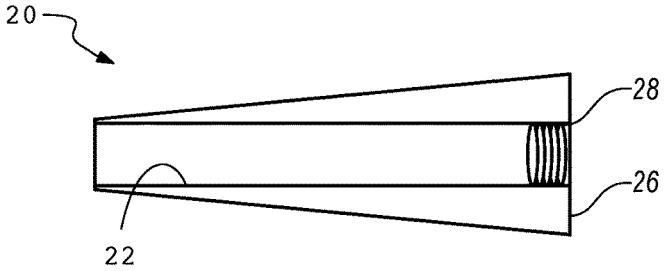
FIG. 2 is a detailed view of the collar

As depicted in FIG. 2, the collar 20 has a length and preferably comprises a tapered over-shaft for fitting around an arrow shaft with a interior collar shaft 22, for receiving the arrow shaft 100 and a collar face 26 for engaging the face plate 16 of the adaptor 10 and a threaded receiver 28 for engaging the threaded neck 18 of the adaptor 10 to secure the collar 20 to the adaptor 10.

Figure 3:
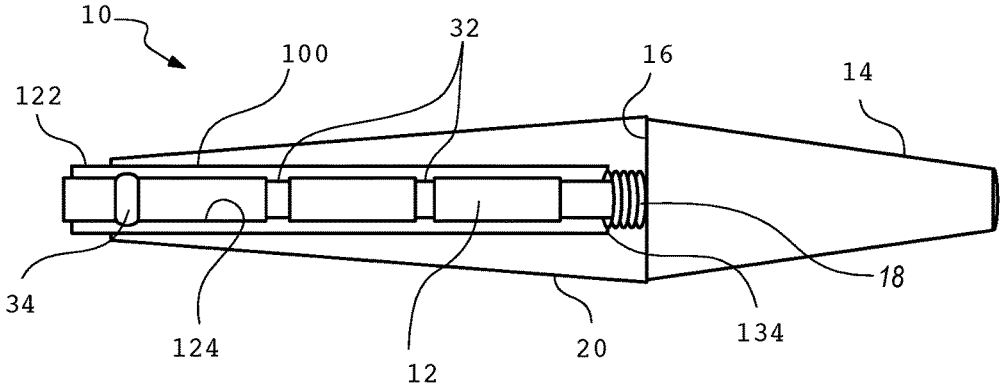
FIG. 3 is a depiction of an arrow shaft with the adaptor and collar in place with an arrow shaft.

In the preferred embodiment the centerpin 12 has a length that extends into the body of the arrow shaft 100 that is greater than the length of the collar 20 such that the full length of any arrow shaft that is secured by the collar 20 is reinforced by the centerpin 12 as depicted in FIG. 3.

FIG. 3 further illustrates the arrow shaft 100 useable with the adaptor 10. The arrow shaft 100 with a wall with an outer surface 122, a forward end face 134 and an inner passage 124. The inner passage 124 and the outer surface 122 define a wall thickness of the arrow shaft. The adaptor 10 and collar 22 being sized such that the centerpin 12 is sized to be placed inside the inner passage 124 and the collar 20 is sized such that the collar shaft 22 matches the outer surface 122 of the arrow shaft 100 and the differential of the collar shaft 22 and the centerpin 12 matches the wall thickness between the outer surface 122 and the inner passage 124.

Figure 4:
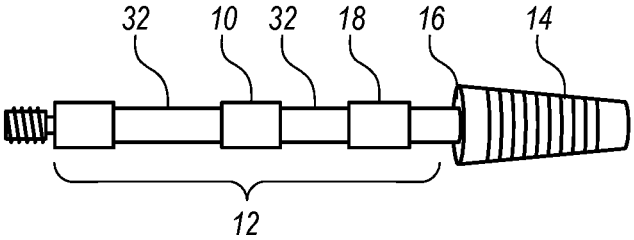
FIG. 4 is a broadhead adaptor

As depicted in FIG. 4, an alternate embodiment of the invention incorporates a single-piece body of unitary construction and places a broadhead 42 type arrow head on the adaptor on the forward end such that the broadhead and the adaptor are fully integrated.

Figure 5:
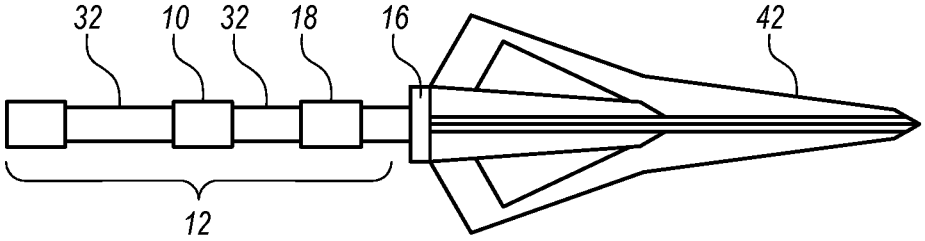
FIG. 5 is a field tip adaptor

As depicted in FIG. 5, an alternate embodiment of the invention incorporates a single-piece body of unitary construction and places field tip 44 type arrow head on the adaptor on the forward end such that the field tip and the adaptor are fully integrated.

In use, the centerpin 12 displaced within the inner passage 124 of the shaft enhances the adaptor's 10 ability to maintain alignment. The centerpin 12 is secured by means such as glue or chemical or friction welding. In the preferred embodiment, displaced along the centerpin 12 are a plurality of recesses 32 of a diameter of less than that of the centerpin 12. Such recesses are provided to facilitate assembly and provide reservoirs for glue or other adhesives to secure the centerpin 12 to the inner passage 124 of an arrow shaft 100. In an alternate embodiment, as depicted in FIG. 3, one or more recesses may be fitted with a flexible O-ring 34 such as a silicone or rubber O-ring 34 to provide vibration dampening.

The collar 20, when joined with the adaptor 10 enhances the adaptor's 10 ability to provide a secure outer fit, increases the strength of the connection, improves aerodynamics and minimizes damage to the forward end of the arrow shaft 100, such as by splitting, chipping or otherwise deforming upon impact of a arrowhead with the target.

Certain embodiments of the present invention include an adaptor with a single-piece body of unitary construction as depicted in FIGS. 4 and 5. The unitary construction can enhance the strength and durability of the adaptor, which can be important when the adaptor is attached to an arrow that is shot repeatedly into a target. The unitary construction can also avoid some difficulties associated with prior adaptors, for example, adaptors that are inserted into the hollow end of an arrow shaft and used in combination with an arrowhead, which may include a portion that extends partially over the outer surface of the arrow shaft. These arrangements are more complex, include additional parts, and require additional steps and time for assembly than the single-piece adaptors of the present invention.

The arrow shaft 100 in certain embodiments is a carbon fiber reinforced shaft although alternate materials for hollow shafts such as aluminum, aluminum-carbon laminates or wood can be used. The adaptor 10 is preferably made of a lightweight material with sufficient strength to withstand the impact forces involved. Examples of materials for the adaptor include aluminum, steel, such as stainless steel, or other lightweight yet strong metals such as titanium. Certain plastics, resins or composites that provide sufficient strength and durability may also be used for the adaptor. The adaptor 10 can be made in various manners such as casting or machining.

The forward end 14 arrowhead attachment portion is depicted as a forward facing opening; however, other embodiments include different types of arrowhead attachment portions for securing an arrowhead to adaptor 10. Additional example embodiments include threaded attachments, locking attachments and protruding arrowhead attachment portions where the arrowhead is mounted over the protrusion.

Furthermore, alternate embodiments include a differently shaped centerpin, means of connecting the adaptor 10 to the collar 20 by means other than threaded screwing, and various shapes and lengths of collars 20 to enhance securement to the arrow shaft 100, maintain alignment, minimize structural damage to or degradation of the arrow shaft, and/or accept different arrow shaft shapes and sizes. Minimizing structural damage to or structural degradation of the arrow shaft 100 can be particularly desirable when the arrow is reused repeatedly, such as during target practice. Additionally, the material from which the arrow shaft 100 is made can affect which type of collar 20 and adaptor 10 suited to provide preferred results.

While illustrated examples, representative embodiments and specific forms of the invention have been illustrated and described in detail in the drawings and foregoing description, the same is to be considered as illustrative and not restrictive or limiting. Any of the foregoing aspects of the present invention may be used in combination with other features, whether or not explicitly described as such. Dimensions, whether used explicitly or implicitly, are not intended to be limiting and may be altered as would be understood by one of ordinary skill in the art. Only exemplary embodiments have been shown and described, and all changes and modifications that come within the spirit of the invention are desired to be protected.

I claim:

1. An arrowhead adaptor for archery comprising:

a forward end and a distal centerpin with a diameter, and a threaded neck displaced coaxially at the intersection of the forward end and the centerpin and a face plate at the terminus of the forward end proximate said threaded neck; and a collar with an interior collar shaft with a diameter and an exterior surface and a forward collar face for engaging said face plate of said adaptor, and on the forward portion of said interior collar shaft a threaded receiver for engaging said threaded neck of said adaptor;

wherein the differential of said diameter of said centerpin and said diameter of said interior collar shaft provides a space for receiving an arrow shaft.

2. The arrowhead adaptor for archery of claim 1 further comprising:

a forward end with a single-piece body incorporating a broadhead arrowhead.

3. The arrowhead adaptor for archery of claim 1 further comprising:

a forward end with a single-piece body incorporating a field tip arrowhead.

4. The arrowhead adaptor for archery of claim 1 further comprising:

one or more recesses displaced along the length of said centerpin.

5. The arrowhead adaptor for archery of claim 4 further comprising:

an o-ring affixed to one or more of said recesses displaced along the length of said centerpin.

6. An arrowhead adaptor for archery comprising:

a forward end and a distal centerpin with a diameter, and a threaded neck displaced coaxially at the intersection of the forward end and the centerpin and a face plate at the terminus of the forward end proximate said threaded neck; and a collar with an interior collar shaft with a diameter and an exterior surface and a forward collar face for engaging said face plate of said adaptor, and on the forward portion of said interior collar shaft a threaded receiver for engaging said threaded neck of said adaptor;

wherein the differential of said diameter of said centerpin and said diameter of said interior collar shaft provides a space for receiving an arrow shaft; and wherein the length of said centerpin is greater than the length of said collar.

7. The arrowhead adaptor for archery of claim 6 further comprising:

a forward end with a single-piece body incorporating a broadhead arrowhead.

8. The arrowhead adaptor for archery of claim 6 further comprising:

a forward end with a single-piece body incorporating a field tip arrowhead.

9. The arrowhead adaptor for archery of claim 6 further comprising:

one or more recesses displaced along the length of said centerpin.

10. The arrowhead adaptor for archery of claim 9 further comprising:

an o-ring affixed to one or more of said recesses displaced along the length of said centerpin.

* * * * *